US006530179B1

(12) United States Patent
Fisher et al.

(10) Patent No.: US 6,530,179 B1
(45) **Date of Patent: *Mar. 11, 2003**

(54) CONTINUOUS EXTRUDED FRAME AND MOVABLE PANEL WITH CONTINUOUS INEXTRUDED HINGE EXTRUDED WITHIN

(76) Inventors: Myles A Fisher, 2003 E. Mallory St., Pensacola, FL (US) 32503; Richard D. Bradley, 818 Amberway Dr., Pensacola, FL (US) 32506; Keith R. Koons, 7107 Santa Barbara St., Pensacola, FL (US) 32526

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 08/855,792

(22) Filed: May 12, 1997

(Under 37 CFR 1.47)

Related U.S. Application Data

(63) Continuation of application No. 08/855,792, filed on May 12, 1997, now abandoned, which is a continuation-in-part of application No. 08/512,118, filed on Aug. 7, 1995, now abandoned.

(51) Int. Cl.[7] ..... E05D 7/00

(52) U.S. Cl. ..... 49/397; 16/254; 16/386; 49/381; 49/501

(58) Field of Search ..... 49/40, 41, 381, 49/388, 397, 400, 501, DIG. 2, 394, 396; 16/386, 337, 254; 52/204–55

(56) References Cited

U.S. PATENT DOCUMENTS

| | | | | | |
|---|---|---|---|---|---|
| 328,900 | A | * | 10/1885 | Moyer | 49/388 |
| 780,610 | A | * | 1/1905 | Jamson | 49/397 |
| 2,233,582 | A | * | 3/1941 | Clark et al. | 49/397 |
| 2,237,696 | A | * | 4/1941 | Biederman | 49/41 |
| 2,868,281 | A | * | 1/1959 | Crimboli | 49/41 |
| 3,047,912 | A | * | 8/1962 | Sobolewski | 49/397 |
| 3,099,866 | A | * | 8/1963 | Matranga | 49/388 |
| 3,164,228 | A | * | 1/1965 | Segre | 49/397 |
| 3,380,218 | A | * | 4/1968 | Fabich | 49/501 |
| 3,389,503 | A | * | 6/1968 | Goess et al. | 49/396 |
| 3,889,422 | A | * | 6/1975 | Nielsen | 49/396 |
| 4,024,605 | A | * | 5/1977 | Henke | 24/33 |
| 4,235,045 | A | * | 11/1980 | Nineberg | 49/41 |
| 4,935,129 | A | * | 6/1990 | Wang | 49/371 |
| 4,974,364 | A | * | 12/1990 | Durham | 49/DIG. 2 |
| 4,979,346 | A | * | 12/1990 | Pollard | 49/DIG. 2 |
| 5,687,518 | A | * | 11/1997 | Endo et al. | 49/DIG. 2 |

* cited by examiner

*Primary Examiner*—Gregory J. Strimbu
(74) *Attorney, Agent, or Firm*—Peter Loffler

(57) ABSTRACT

A continuously extruded profile sash and frame each having an integral rigid hinge thereon. The device comprises an operable hinge system wherein the load bearing hinge mechanics are extruded as an integral part of the extruded frame member and of the extruded sash moving panel, the sash and frame can each have a cell structure for increased structural integrity and thermal insulating capacity. A punch press may be used to create the male knuckle and female hinge components. At least one hinge pin can be inserted into the cylindrical cavity and run the length of the hinge. Panel and frame members include arcuate sides.

14 Claims, 7 Drawing Sheets

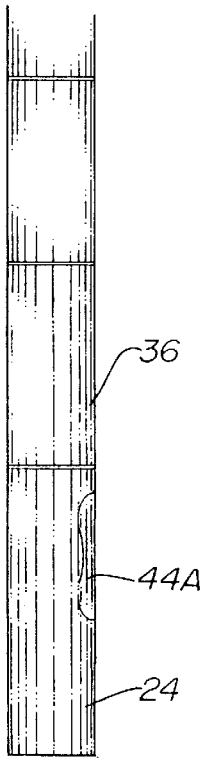
FIG. 9
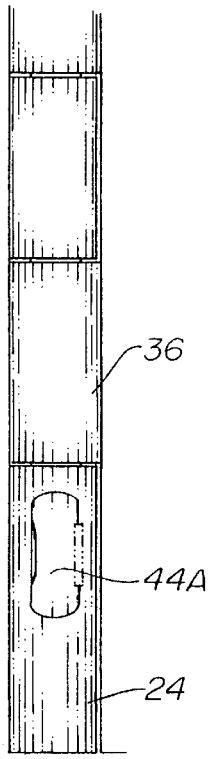
FIG. 10
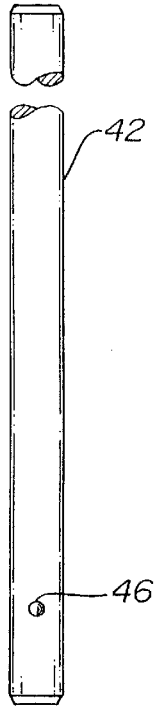
FIG. 11
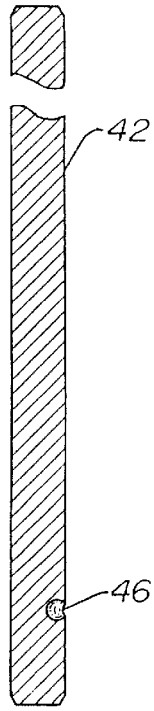
FIG. 12
FIG. 13
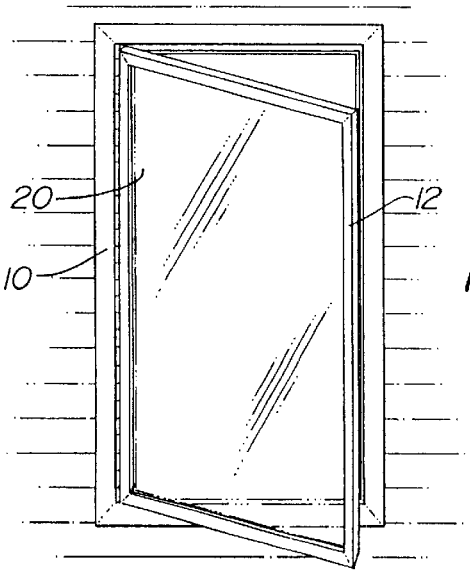
FIG. 14
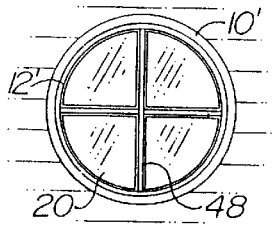
FIG. 15
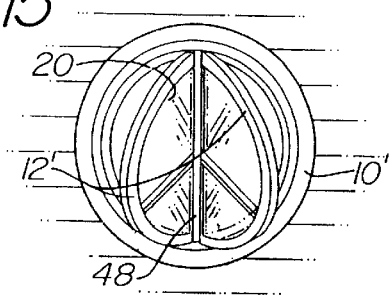

FIG. 16
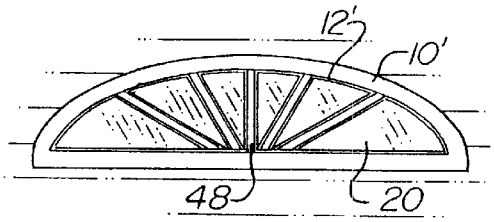
FIG. 17
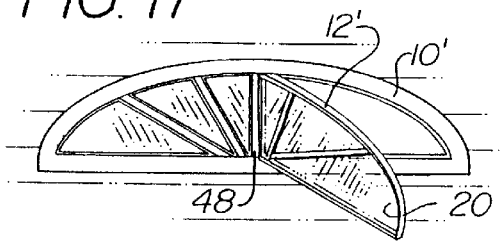
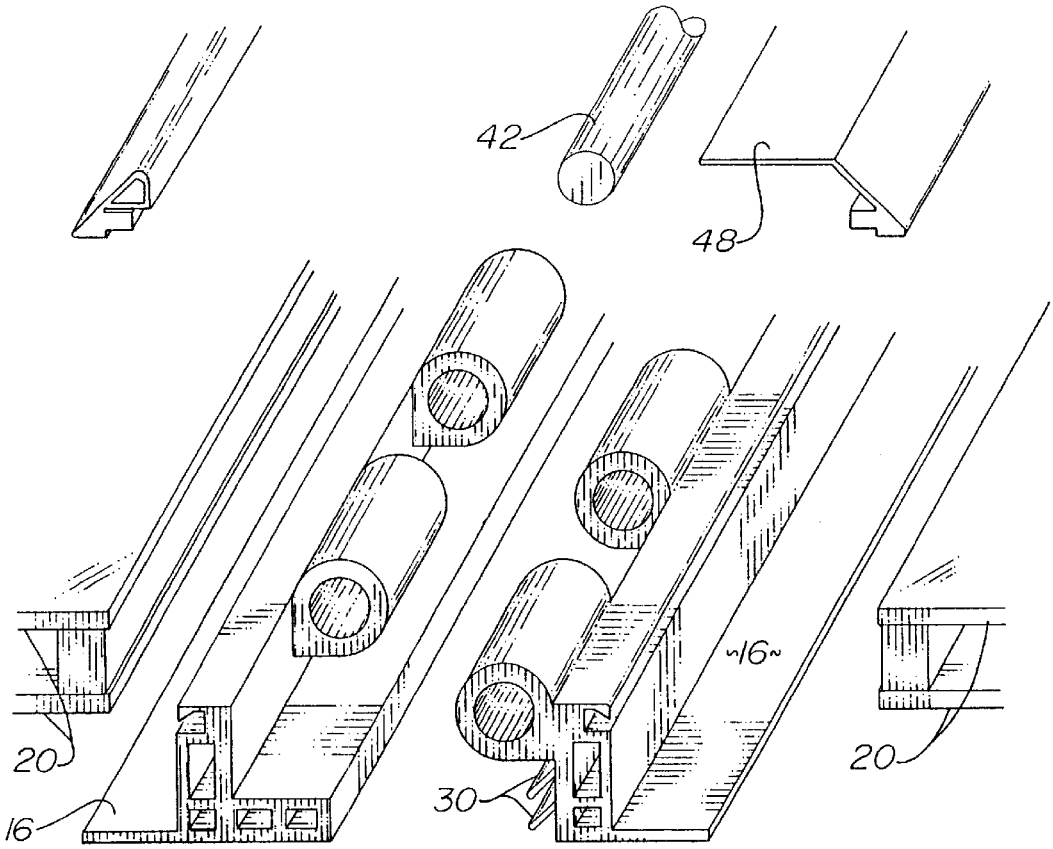
FIG. 18

CONTINUOUS EXTRUDED FRAME AND MOVABLE PANEL WITH CONTINUOUS INEXTRUDED HINGE EXTRUDED WITHIN

This application is a continuation of patent application Ser. No. 08/855,792 filed May 12, 1997, now abandoned, which is a continuation-in-part of patent application Ser. No. 08/512,118, filed Aug. 7, 1995, now abandoned.

BACKGROUND OF THE INVENTION

1. Field of the Invention

The present invention relates generally to panel-holding sashes or framing strips, and more particularly to sashes or strips having extruded rigid hinge members formed thereon.

2. Background of the Prior Art

Top, side, and bottom hinged windows are comprised of three major components: the glass-bearing sash, the window frame, and the hinges that attach the sash to the frame. Typically, two or more high-quality butt hinges or concealed scissor hinges are used for the above attachment. These hinges, which add to the cost of the hinge window, must be attached to the frame and the sash with extreme care. In order to help reduce the problem of sash sag—which results in sash drag whereby the sash drags across the frame—the hinges must be assembled and thereafter affixed to each component within very tight tolerances. Deviations from the required tolerances will cause sash sag and render the window useless. Achieving such tight tolerances is very labor intensive and thus increases manufacturing costs.

Even if the top, side, or bottom hinged window is assembled correctly, sash sag can still occur. The window frame and the sash must remain absolutely square from initial assembly to final installation within a structure, otherwise sash sag will result. The hinge assembly can become distorted during shipping or installation resulting in sash sag.

Over time, the cantilevered weight of the sash will place stress on the hinges, especially the upper hinge, resulting in sash sag. In order to reduce this problem in side-hinged casement windows, manufactures recommend that the sash width be limited to 66 percent of the sash height.

If a window breaks or a hinge needs replacement due to corrosion or other effects, the hinge screws must be removed with extreme care. If the screw bore hole is stripped or otherwise deformed, either the window frame or the sash must be completely replaced in order to maintain optimum operating efficiency.

Many precautions can be taken to help reduce the sash sag problem. Such precautions include precise hinge positioning within extremely tight tolerances, absolutely straight positioning of hinge mount screws, appropriate cure time of glaze application, unconventional diagonal blocking of the glass within the sash, prevention of sash movement or bounce within the frame during the shipment of the top, side, or bottom hinged window, and many other time-consuming and costly precautions. While these and other precautions deter occurrence of sash sag, they can add greatly to the manufacturing and installation costs of the hinged window.

A system is needed wherein the problem of top, side, or bottom hinged window sash sag is virtually eliminated without the need for expensive hardware or manufacturing and installation techniques.

SUMMARY OF THE INVENTION

The present invention provides for a top, side, or bottom hinged panel system wherein the occurrence rates of sash sag are sharply reduced and the costs of manufacturing, installation, and replacement of the hinged panel are also reduced.

The present invention comprises an operable hinge system wherein the load bearing hinge mechanics are extruded as an integral part of the extruded frame member and of the extruded sash moving panel, with the hinge cavity being formed as a result of the extrusion process. A punch press can be used to create the male-female hinge components. One or more hinge pins can be inserted into and run the length of the aligned hinge knuckles. Ideally, these one or more pins will be flexible so that they may be inserted through one or more side openings located on the hinge elements. Such side installment is necessary for ease of pin removal and replacement for recessed windows.

The benefits of such a hinge system are multifold. The use of expensive hinge hardware as well as the cost of the accurate positioning of the hinge hardware is eliminated. Installation is relatively straightforward and once installed, the top, side, or bottom hinged panel is virtually maintenance free. The weight of the sash is evenly distributed along the entire length of the hinge side of the sash, which enables the panel manufacturer to construct a square sash as well as a non-rectangular curve shaped sash. Removal and replacement of a sash is greatly simplified. The top, side, or bottom hinged panel so produced will lack the unsightly loose butt hinges.

Many other benefits will also be realized including the ability to utilize a hinge system on a generally circular or a generally semicircular shaped panel frame and sash.

The above hinge system will have widespread applicability to all panel manufactures utilizing extruded frame and sash materials.

Therefore it is an object of the present invention to provide a movable top, side, or bottom hinged panel wherein the problems associated with sash sag are greatly reduced.

It is another object of the present invention to provide a movable top, side, or bottom hinged panel having reduced manufacturing costs.

It is another object of the present invention to provide a movable top, side, or bottom hinged panel having reduced installation costs.

It is another object of the present invention to provide a movable top, side, or bottom hinged panel having reduced removal and replacement costs.

It is a final object of the present invention to provide a movable hinged panel that can be manufactured in a variety of shapes and sizes and hinged from jamb, sill or head or from a structural muntin.

BRIEF DESCRIPTION OF THE DRAWINGS

FIG. 9 is a partial side view of the hinge system of the present invention.

FIG. 10 is a rotated partial side view of the hinge system of FIG. 9.

FIG. 11 a side view of the hinge pin of the present invention.

FIG. 12 is a section view of the hinge pin of FIG. 11.

FIG. 13 is a perspective view of a hinged sash utilizing the device of the present invention.

FIG. 14 is an elevation view of generally circular sashes utilizing he device of the present invention.

FIG. 15 is an elevation view of generally circular sashes of FIG. 14 in the open position.

FIG. 16 is an elevation view of a generally semicircular sash utilizing the device of the present invention.

FIG. 17 is an elevation view of a generally semicircular sash of FIG. 16 in the open position.

FIG. 18 is a partial perspective view of a pair of hinge components of a generally circular or a generally semicircular sash of the device of the present invention.

DETAILED DESCRIPTION OF THE PREFERRED EMBODIMENT

Figure 2:
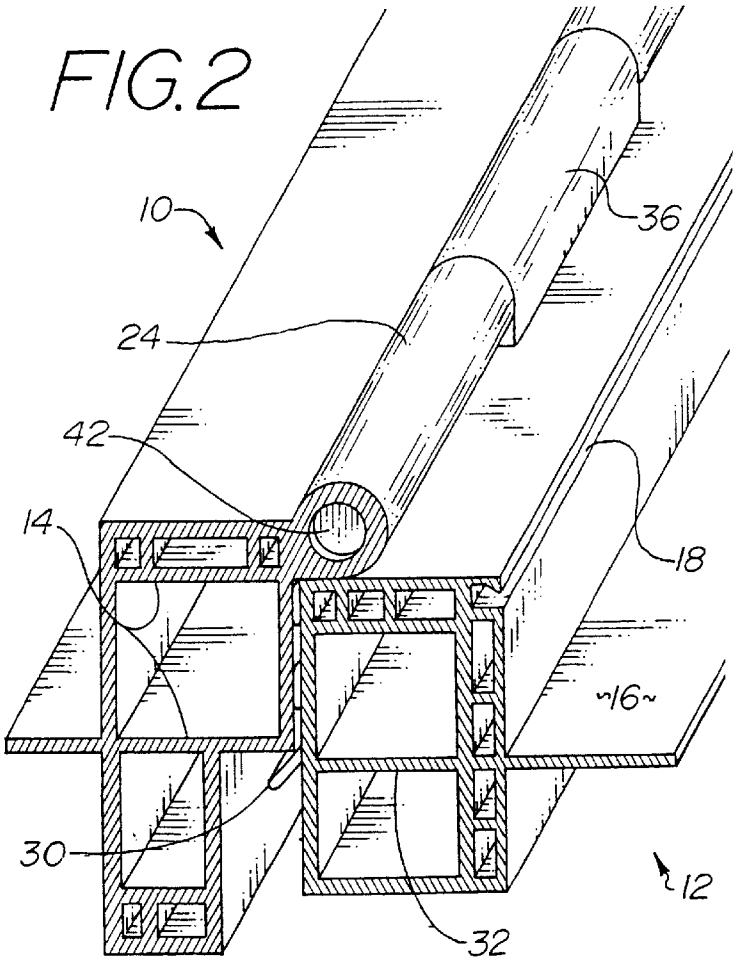
FIG. 2 is a partial perspective view of the sash hinge mate with the frame hinge in a closed position.
Figure 1:
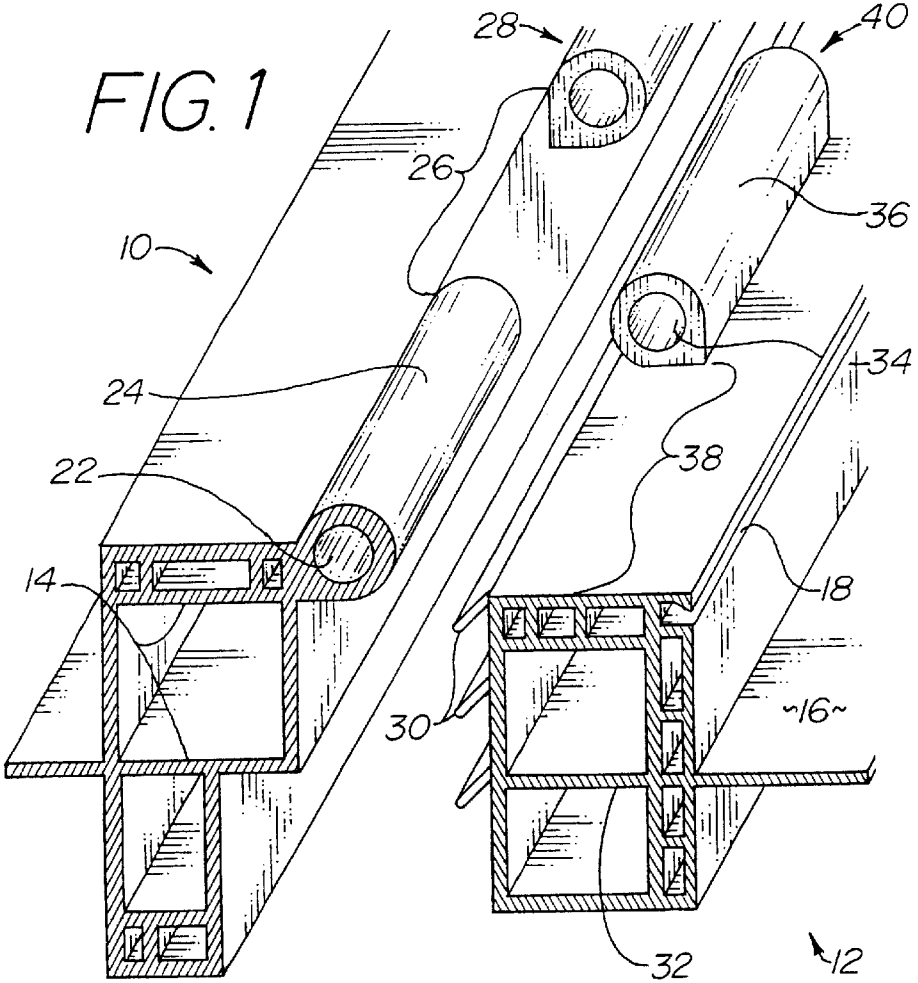
FIG. 1 is a partial perspective view of a frame and sash utilizing the extruded integral hinges of the present invention.

The present invention comprises a continuously extruded profile sash 12 and a frame 10. The sash 12 is an extruded member having a cell structure 32 for increased structural integrity, a glaze seat 16, and a receptacle 18 for a glaze retention strip. A glaze member 20 is received on the glaze seat 16. Integrally extruded on the sash 12 is a cylindrical cavity 34. The cylindrical cavity 34 is generally straight and will run the entire length of the sash 12. A punch press can be used to create the male knuckles 36 and female component 38 on the cylindrical cavity forming the sash hinge system 40. Co-extruded on the sash 12 is a series of weather-stripping ribs 30.

The frame 10 is a continuously extruded profile member having a cell structure 14 for increased structural integrity. Integrally extruded on the frame 10 is a cylindrical cavity 22. The cylindrical cavity 22 is generally straight and will run the entire length of the side of the frame 10. A punch press can be used to create the male knuckles 24 and female components 26 on the cylindrical cavity forming the frame hinge system 28.

The structure, which can be a single cell or multiple cells, of both the sash and the frame offer greater structural integrity to the device as well as increased structural integrity to the installed device. Furthermore, most, if not all cells are closed, the one or more cells 14 and 32 increase the insulation capacity of the installed window.

As seen in FIG. 2, the male components of each hinge fit into and interact with the female components of the other hinge. Once so interacted, the male knuckles 24 of the frame 10 are generally aligned with the male knuckles 36 of the sash and form a generally straight cavity.

When the frame hinge system 28 and the sash hinge system 40 are mated, at least one flexible hinge pin 42 is inserted into the aligned cylindrical cavities 22 and 34. Once fully inserted into the cylindrical cavities, each hinge pin 42 will be straight and will operate as a normal straight hinge pin. Pin 42 insertion can be accomplished by providing one or more small openings 44 on one or more of the male knuckles of the frame 10 or the sash 12 or both and inserting each flexible hinge pin 42 into one of the small openings 44 and forcing the pin 42 up the entire length of the aligned cylindrical cavities of the mated knuckles. The end of the pin 42 has a small depression 46 located thereon. When the pin 42 is almost entirely inserted into the aligned cylindrical cavities 22 and 34, the end of a ball-tipped tool T is inserted into the depression 46 of the pin 42. The tool T is used to slide the remainder of the pin 42 into the cavities. Once the tool T is removed, the pin 42 will come to rest in place within the cylindrical cavities. Each small opening 44 is capped by cap 44a. In order to remove the pin 42, the tool T is used to help extract the pin 42 from the cylindrical cavities. It will be understood that other methods of pin insertion and extraction, including those associated with rigid pins, are possible.

Figure 4:
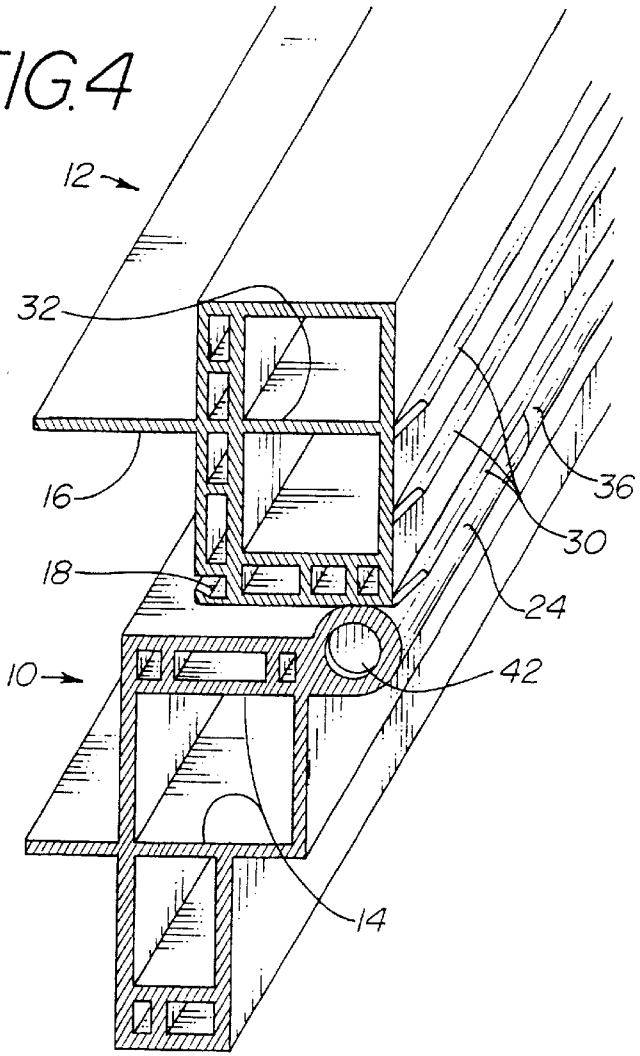
FIG. 4 is a partial perspective view of the sash hinge mated with the frame hinge in a 180-degree open position.
Figure 3:
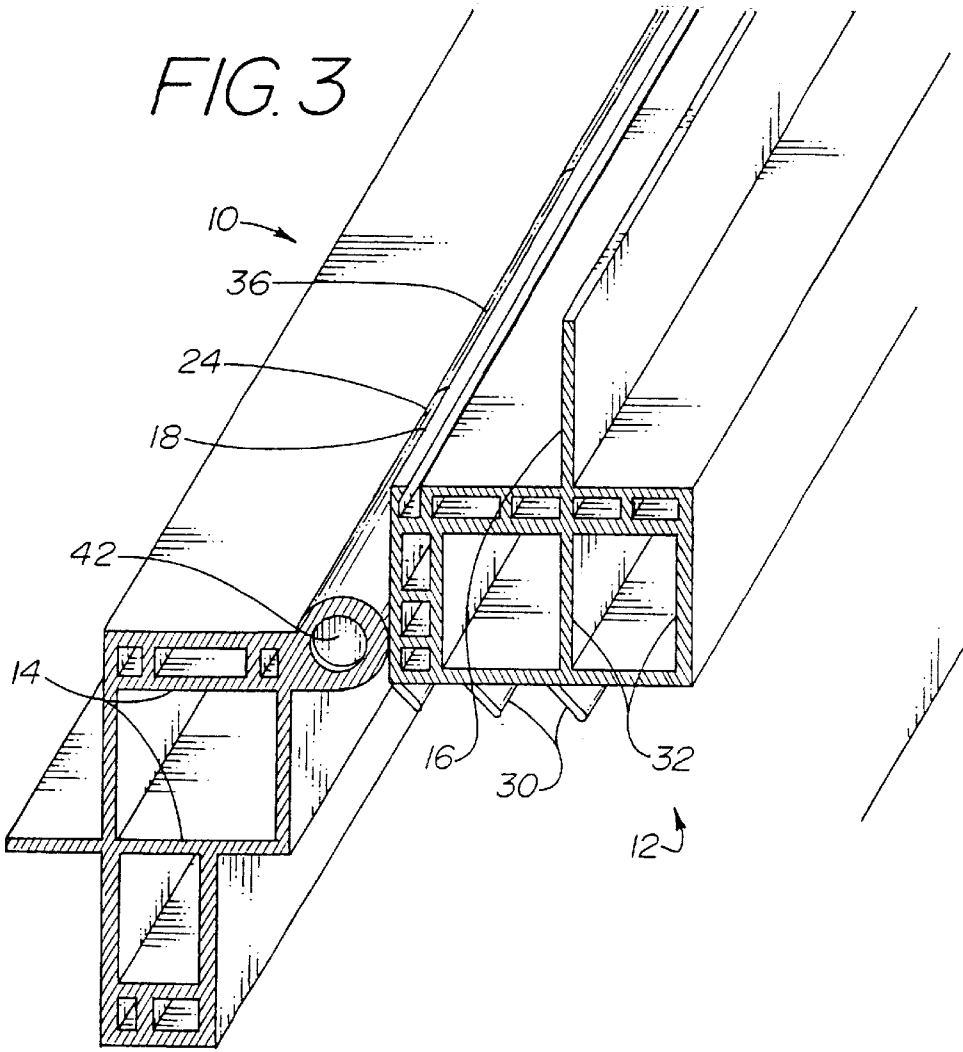
FIG. 3 is a partial perspective view of the sash hinge mated with the frame hinge in a 90-degree open position.
Figure 5:
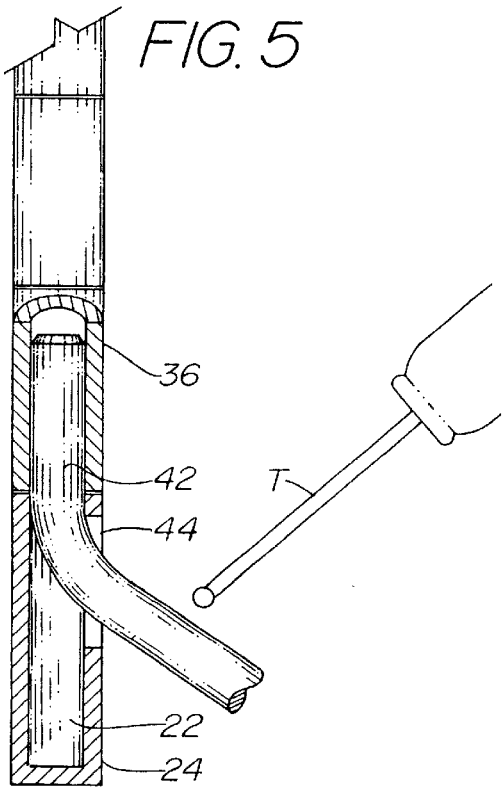
FIG. 5 is a partial sectional view of a flexible hinge pin being inserted into the hinge system.
Figure 6:
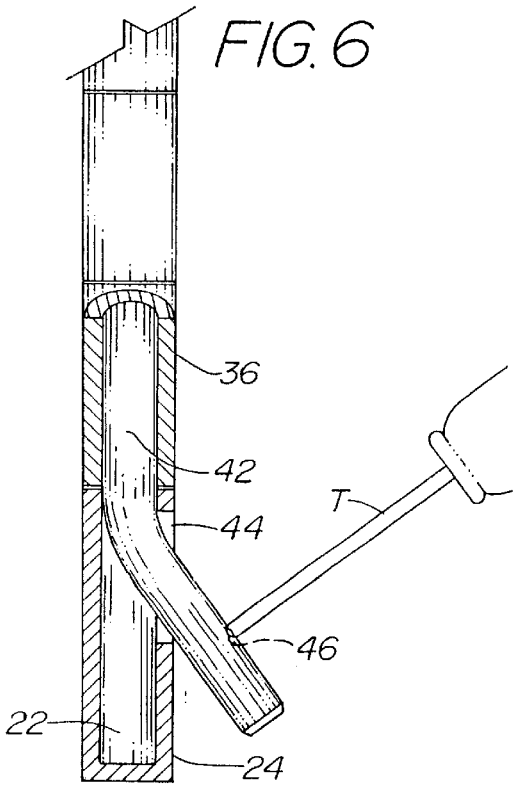
FIG. 6 is a partial sectional view of the end of the flexible hinge pin being inserted into position in the hinge system.
Figure 7:
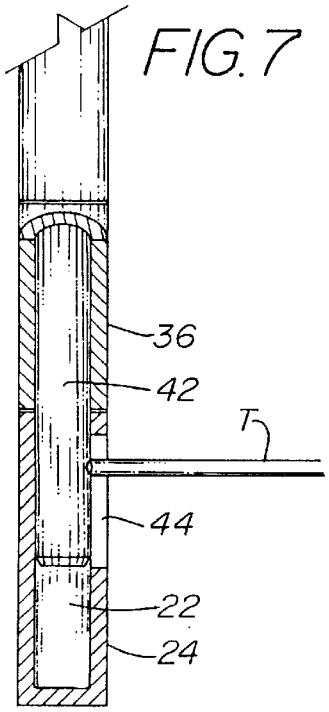
FIG. 7 is a partial sectional view of the flexible hinge pin fully inserted within the hinge system.
Figure 8:
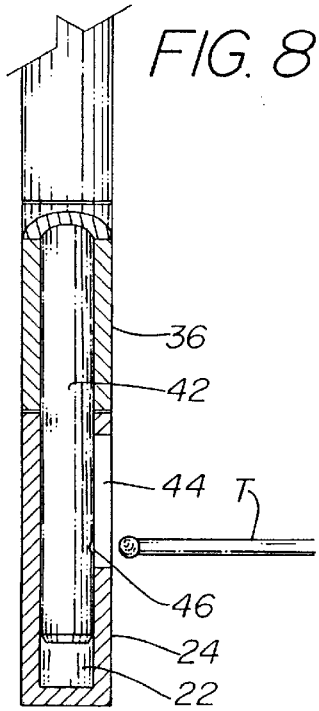
FIG. 8 is a partial sectional view of the flexible hinge pin in final position within the hinge system.
Figure 19:
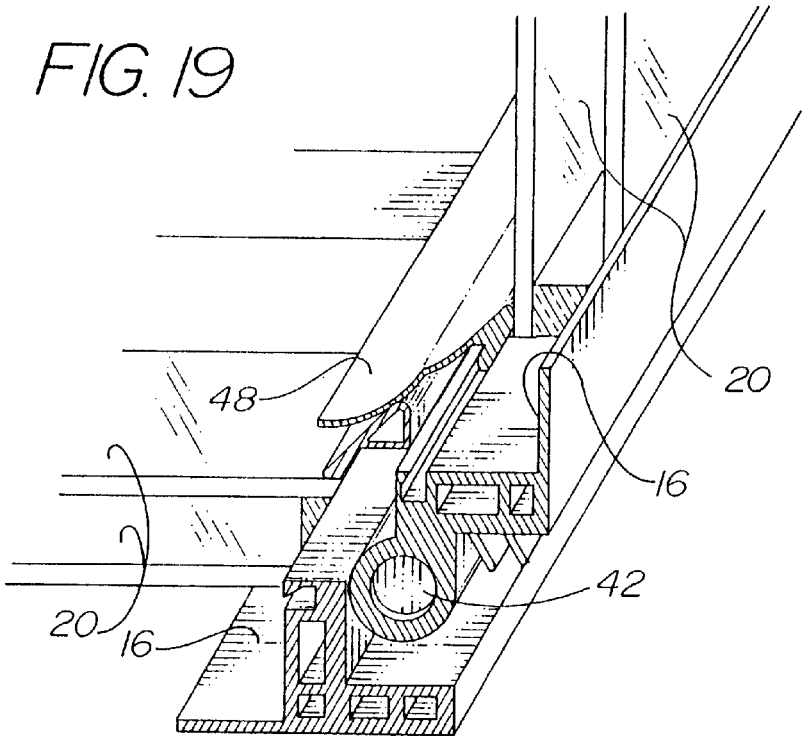
FIG. 19 is a partial perspective view of a pair of hinge components, mated with one another, of a generally circular or a generally semicircular sash of the device of the present invention.
Figure 20:
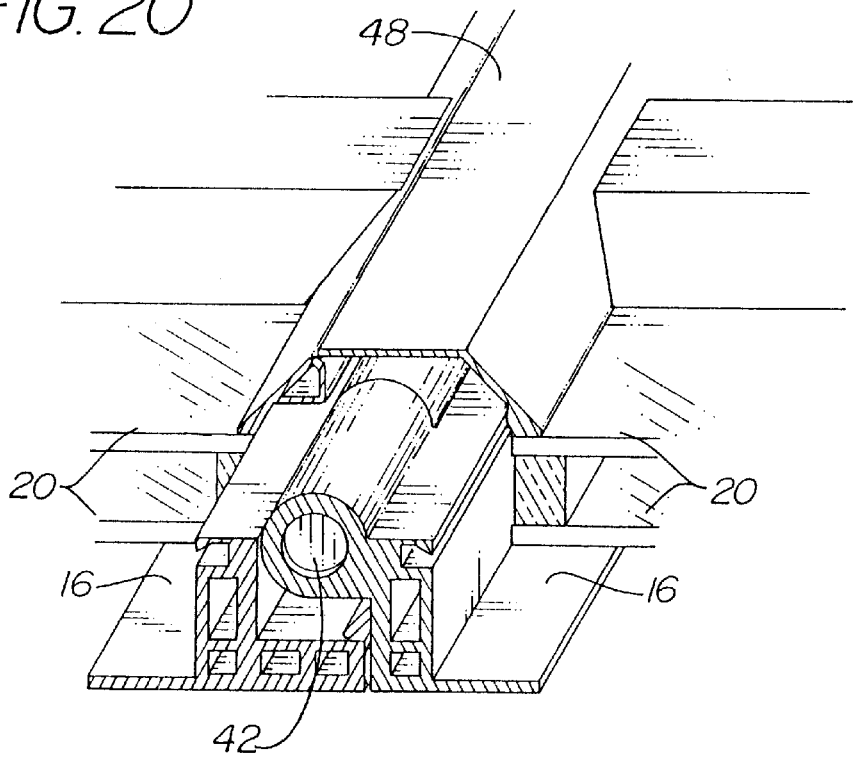
FIG. 20 is a partial perspective view of a cover placed over the hinged system of a generally circular or generally semicircular sash utilizing the device of the present invention.
Figure 21:
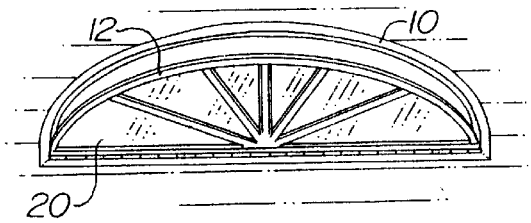
FIG. 21 is a perspective view of a generally semicircular sash utilizing a bottom disposed hinge.
Figure 22:
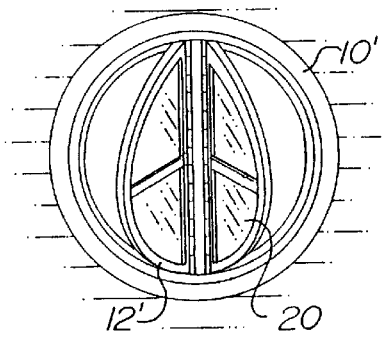
FIG. 22 is a perspective view of a generally circular frame utilizing a structural muntin.
Figure 23:
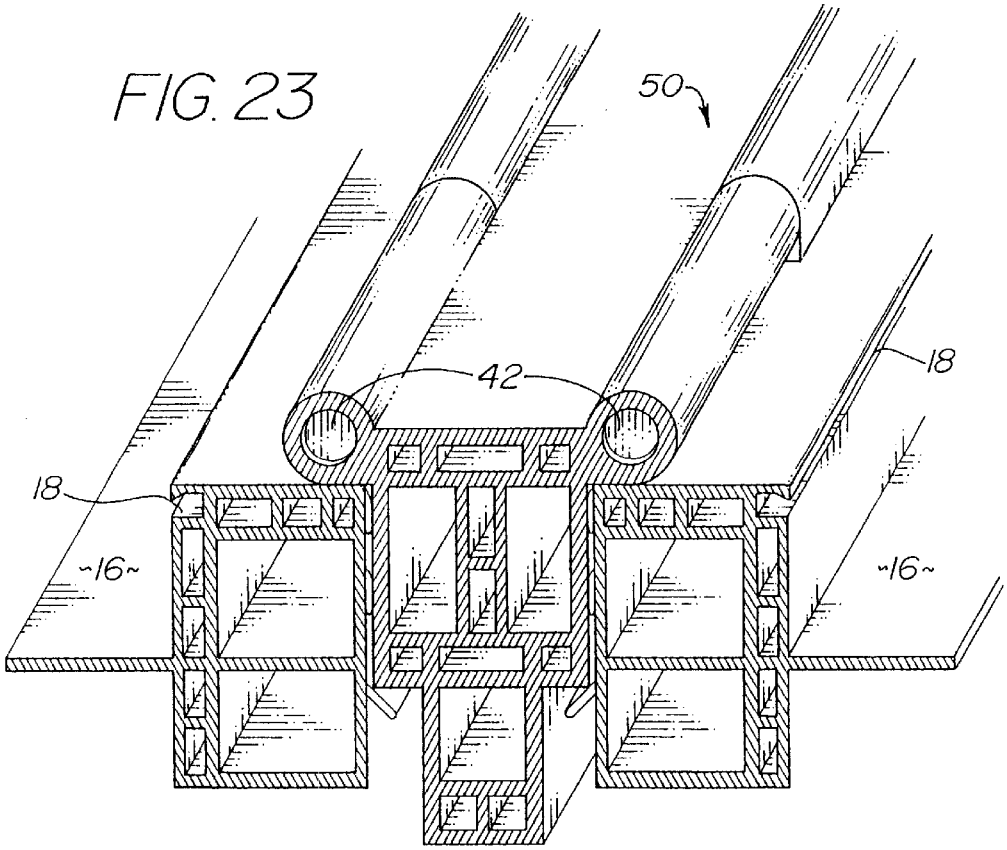
FIG. 23 is a partial perspective view of two sets of hinge components of a pair of sashes mated with the hinge components of a structural muntin.

As seen in FIG. 2, when the sash 12 and frame 10 are in a closed position, the ribs 30 of the sash 12 contact the frame 10 and provide weather-stripping capabilities. As seen in FIGS. 3 and 4, the placement of the hinges permits panel opening up to over 180-degrees from the closed position.

As seen in FIGS. 14–17, the present invention permits arcuate-shaped sashes including, generally circular, generally semicircular shaped sashes, to be openable. As seen, a pair of semicircular shaped sash members 12' (if generally circular framing structures are being utilized), or a pair of quarter-circular shaped sash members 12' (if generally semicircular framing structures are being utilized), each have male knuckles 36 and female components 38. The male knuckles and female components of one sash member are mated with the male knuckles and female components of a mirror image sash member. These hinge components are created in the usual way. A hinge pin 42 is inserted into the aligned cylindrical cavities of the two sashes and can be secured to the top and the bottom of the frame 10'. A cover 48, extends from one edge of a generally circular- or generally semicircular shaped frame 10' to the opposing edge. Each sash member is free to rotate, independent of the other sash, about its cylindrical cavity 34.

Alternatively, a structural muntin 50 can extend from the top to the bottom of the frame 10'. The structural muntin 50 would have male knuckles and female components on one or both sides of the muntin 50. The male knuckles and female components would be constructed in the usual way. Male knuckles and female components of a sash or sashes are mated with the male knuckles and female components located on one or both sides of the muntin 50 creating the movable panel or panels.

While the invention has been particularly shown and described with reference to an embodiment thereof, it will be recognized by those skilled in the art that various changes in form and detail may be made without departing from the spirit and scope of the invention.

What is claimed is:

1. A frame and movable window panel member comprising:

a frame member having a closed polygon shape and having at least one straight side and having a cell structure, wherein each cell of the cell structure defines a cavity;

a first set of spaced apart male knuckles, each having a first cavity, continuously and integrally extruded on the at least one straight side of the frame member;

a panel member having at least one straight side and having a cell structure, wherein each cell of the cell structure defines a cavity;

a second set of spaced apart male knuckles, each having a second cavity, and adapted to mate with the first set of spaced apart male knuckle, continuously and integrally extruded on the at least one straight side of the panel member;

at least one rod; and wherein the frame member and panel member are aligned so that the first set of male knuckles mate with the second set of male knuckles such that each first cavity is aligned with each second cavity on their respective longitudinal axis and each of the at least one rod is inserted into the aligned first cavities and the second cavities.

2. The frame and movable window panel as in claim 1 wherein each of the at least one rod is flexible.

3. The frame and movable window panel member as in claim 1 further comprising at least one opening located on the side of at least one of the first set of male knuckles or at least one of the second set of male knuckles.

4. The frame and movable window panel member as in claim 1 wherein the frame has at least one arcuate side and the panel member has at least one arcuate side.

5. The frame and movable window panel member as in claim 1 wherein the panel member is generally semicircular shaped, and the frame member is generally semicircular shaped.

6. A frame and movable window panel members comprising:

a first continuously extruded profile panel member having at least one straight side and at least one arcuate side and having a cell structure, wherein each cell of the cell structure defines a cavity;

a first set of spaced apart male knuckles, each having a first cavity, continuously and integrally extruded on the at least one straight side of the first panel member;

a second continuously extruded profile panel member having at least one straight side and at least one arcuate side and having a cell structure, wherein each cell of the cell structure defines a cavity;

a second set of spaced apart male knuckles, each having a second cavity, continuously and integrally extruded on the at least one straight side of the second panel member;

a frame member having at least one arcuate side, a rod; and wherein the first panel member and the second panel member are each positioned within the frame member and are aligned so that the first set of male knuckles of the first panel member mate with the second set of male knuckles of the second panel member such that the first cavities are aligned with the second set of cavities on their respective longitudinal axis and the at least one rod is inserted into the aligned first cavities and the second cavities.

7. The frame and movable window panel members as in claim 6 wherein the first panel member is generally semicircular shaped, the second panel member is generally semicircular shaped, and the frame member is generally circular shaped.

8. The frame and movable window panel members as in claim 6 wherein the first panel member is generally quarter-circular shaped, the second panel member is generally quarter-circular shaped, and the frame member is generally semicircular shaped.

9. The frame and movable window panel members as in claim 6 wherein each of the at least one rod is flexible.

10. A frame and movable window panel member comprising:

a first continuously extruded profile panel member having at least one straight side and at least one arcuate side and having a cell structure, wherein each cell of the cell structure defines a cavity;

a first set of spaced apart male knuckles, each having a first cavity, continuously and integrally extruded on the at least one straight side of the first panel member;

a frame member having at least one arcuate side and having a cell structure, wherein each cell of the cell structure defines a cavity;

a structural muntin, extending from one side of the frame member to the opposing side of the frame member, having a first side and a second side;

a second set of spaced apart male knuckles, each having a second cavity, continuously and integrally extruded on the muntin;

a first set of at least one rod; and wherein the first panel member is positioned within the frame member and is aligned so that the first set of male knuckles of the first panel member mate with the second set of male knuckles of the structural muntin such that the first cavities are aligned with the second cavities on their respective longitudinal axis and the first set of at least one rod is inserted into the aligned first cavities and the second cavities.

11. The frame and movable window panel member as in claim 10 further comprising:

a second continuously extruded profile panel member having at least one straight side and at least one arcuate side and having a cell structure;

a third set of spaced apart male knuckles, each having a third cavity, continuously and integrally extruded on the at least one straight side of the second panel member;

a fourth set of spaced apart male knuckles, each having a fourth cavity, continuously and integrally extruded on the muntin;

a first set of at least one rod; and wherein the second panel member is positioned within the frame member and is aligned so that the third set of male knuckles of the second panel member mate with the fourth set of male knuckles of the structural muntin such that the third cavities are generally aligned with the fourth cavities and the second set of at least one rod is inserted into the aligned third cavities and the fourth cavities.

12. The frame and movable window panel member as in claim 11 wherein the first set of at least one rod and the second set of at least one rod are each flexible.

13. The frame and movable window panel member as in claim 11 wherein the first panel member is generally semicircular shaped, the second panel member is generally semicircular shaped, and the frame member is generally circular shaped.

14. The frame and movable window panel member as in claim 11 wherein the first panel member is generally quarter-circular shaped, the second panel member is generally quarter-circular shaped, and the frame member is generally semicircular shaped.

* * * * *